US010947725B2

(12) United States Patent
Lin et al.

(10) Patent No.: US 10,947,725 B2
(45) Date of Patent: Mar. 16, 2021

(54) SUSPENDED CEILING PASS THROUGH GRID CONNECTOR

(71) Applicant: Worthington Armstrong Venture, Malvern, PA (US)

(72) Inventors: Yu Lin, Blue Bell, PA (US); Brett W. Sareyka, Glen Mills, PA (US); Joseph Auriemma, Jr., Eagleville, PA (US); Joshua L. Neal, Phoenixville, PA (US); Sebastien Place, Chester Springs, PA (US); Jeff Markley, Middle River, MD (US); Jason Robbins, East Earl, PA (US); Nicholas Shaffer, Norristown, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 16/675,378

(22) Filed: Nov. 6, 2019

(65) Prior Publication Data

US 2020/0149275 A1 May 14, 2020

Related U.S. Application Data

(60) Provisional application No. 62/757,252, filed on Nov. 8, 2018, provisional application No. 62/888,718, filed on Aug. 19, 2019.

(51) Int. Cl.
*E04B 9/18* (2006.01)
*E04B 9/06* (2006.01)

(52) U.S. Cl.
CPC ..... *E04B 9/18* (2013.01); *E04B 9/068* (2013.01)

(58) Field of Classification Search
CPC ..... E04B 9/068; E04B 9/18
See application file for complete search history.

(56) References Cited

U.S. PATENT DOCUMENTS 3,015,375 A 1/1962 Lickliter et al.
5,349,800 A * 9/1994 Peng ..... E04B 9/127 403/174

(Continued)

FOREIGN PATENT DOCUMENTS

| | | |
|---|---|---|
| DE | 2830797 | 1/1980 |
| EP | 1857604 | 11/2007 |
| FR | 2922237 | 4/2009 |

OTHER PUBLICATIONS

International Search Report for corresponding International Application No. PCT/US2019/060197 dated Jun. 2, 2020.

*Primary Examiner* — Andrew J Triggs
(74) *Attorney, Agent, or Firm* — Stradley Ronon Stevens & Young, LLP

(57) ABSTRACT

A pass through grid connector clip for a suspended ceiling. The grid connector clip is made of two identical halves connected back-to-back by a fastener passing through a first aperture of both identical halves or other joining method. The identical halves each have a web with a first side and an opposite second side defining a height; a third side and an opposite fourth side defining a length; a louver element closer to a fourth side than the third side; a half sleeve located between the clip and the louver element and extending from the first side to the second side the in a substantially semi-circular shape; the first aperture located between the half sleeve and the clip or the half sleeve and the louver element. The halves include a clip connected to the third side and two flanges projecting in substantially the same direction from opposite sides of the web. As a result, when the halves are joined back-to-back they form a pass through sleeve.

20 Claims, 6 Drawing Sheets

(56) References Cited

U.S. PATENT DOCUMENTS

| | | | | |
|---|---|---|---|---|
| 2003/0024196 | A1* | 2/2003 | Huang | E04B 9/18 52/506.06 |
| 2012/0240495 | A1 | 9/2012 | Eychaner et al. | |
| 2013/0276389 | A1* | 10/2013 | Marrs | E04B 2/74 52/173.1 |
| 2015/0308617 | A1* | 10/2015 | Sareyka | E04B 9/068 52/506.07 |
| 2020/0149275 | A1* | 5/2020 | Lin | E04B 9/12 |

* cited by examiner

SUSPENDED CEILING PASS THROUGH GRID CONNECTOR

RELATED APPLICATION

This application claims the benefit of priority to U.S. Provisional Patent Application Ser. No. 62/757,252, filed on Nov. 8, 2018, and 62/888,718, filed on Aug. 19, 2019, the contents of which are incorporated in this application by reference.

FIELD OF THE INVENTION

The invention relates generally to a suspended ceiling system. More particularly, the invention relates to a pass through grid connector that allows threaded rods attached to a structural ceiling to pass through the suspended ceiling to the room below without compromising the containment zones provided by the suspended ceiling.

BACKGROUND OF THE DISCLOSURE

There are many applications in which a load must be hung below a suspended ceiling. Unfortunately, such loads may be more than the suspended ceiling can bear. One example of such environments where heavy loads are hung below a suspended ceiling are data centers.

A data center is a facility which houses computer systems and associated components such as telecommunications and storage systems. Data centers may include redundant or backup power supplies for a computer system, redundant data communications connections and environmental controls including air conditioning and fire suppression systems. Data centers are frequently used to house servers in large numbers. Extensive hardware such as racks, conduits, cables, cable trays, elevated floors and the like may be necessary to store, organize and connect the functional components of a computer system in a data center. To permit efficient use of space, such hardware may be suspended by, for example, threaded rods.

With worsening air pollution throughout the world, many data centers in urban areas are experiencing an increase in mechanical failures due to poor air quality, showcasing the need for an effective air filtration system. Suspended ceilings assist in isolating and containing zones of cooled and/or clean air to assist in data center operations and increase efficiency. The problem is the weight of the data center components. Fully loaded server racks can weight over a thousand pounds. A suspended ceiling cannot support such weight.

To accommodate such weight or similar applications, threaded rods may be required to pass through the suspended ceiling to attach to the structure above. However, such rods may compromise the containment zones provided by the suspended ceiling.

Conversely, a ceiling attached to the structure may be constructed. However, such a ceiling must be assembled in small sections on the ground and hoisted into its final installed position. Such a method of installation requires bulky jigs and lifting systems.

Accordingly, there is a need for an easy to install ceiling systems that does not require jigs or a hoist, which permits load bearing rods to pass through suspended ceilings while not compromising the zone barrier provided by the suspended ceiling.

SUMMARY OF THE INVENTION

To achieve this and other desires, and in view of its purposes, the present invention provides a suspended ceiling pass through grid connector. The disclosed clip allows a load bearing member to pass through the ceiling grid without having to modify ceiling tiles or grid components. This clip provides six key advantages. First, high loads can be supported below the suspended ceiling. Second, time, cost, and effort of installation are reduced when compared to structural ceiling systems. Third, the clip allows objects (e.g., threaded rods) to pass through the ceiling without requiring field modifications to grid and tiles. Fourth, the convenience and appearance of a suspended ceiling is preserved. Fifth, no load is imparted on the ceiling system from the structure below. Sixth, the separation of the containment zones provided by the suspended ceiling is maintained.

The pass through grid connector is formed of two identical halves connected back-to-back. The identical halves each comprising a web having: (1) a first side and an opposite second side defining a height; (2) a third side and an opposite fourth side defining a length; (3) a louver element closer to a fourth side than the third side; (4) a clip integrated with or connected to the third side; (5) a half sleeve located between the clip and the louver element and extending from the first side to the second side the in a substantially semi-circular shape; (6) a first aperture located between the half sleeve and the clip or the half sleeve and the louver element; (7) a first flange connected to the first side and projecting outward from the web in the direction of the half sleeve; and (8) a second flange connected to the second side and projecting outward from the web in the direction of the half sleeve. In some embodiments, the first aperture is defined by a substantially circular protuberance projecting substantially perpendicularly outward from the web in a direction opposite the second flange.

In certain embodiments, the clip includes a thumbnail located on the clip and projecting outward from the clip in a direction opposite the first flange. Furthermore, the web may include a second aperture closer to the third side than the first aperture.

In other embodiments, each identical half includes a notch located on the fourth side. In certain embodiments, the notch is substantially centrally located along the height of the web.

In further embodiments the web includes a third aperture adapted to engage with the protuberance defining the first aperture. Conversely, in other embodiments, the third aperture is adapted to accept a hang wire. In other embodiments, the third aperture is aligned with the first aperture along the height or length of the web.

In certain embodiments, the clip includes a terminal side furthest from the web and a guide connected to the terminal side projecting at an angle in a direction away from the second flange. The clip may also include at least one protuberance projecting outward in the direction of the second side. In addition, in certain embodiments, the clip includes at least one stiffening element projecting outward from the clip in a direction of the second flange.

In certain embodiments, the identical halves are connected by a cap joining their second flanges. In other embodiments, the identical halves are joined by a fastener passing through aligned first apertures or first apertures aligned with third apertures. In further embodiments, the identical halves are joined by a fastener passing through aligned first apertures or first apertures aligned with third apertures and their second flanges are joined with a cap.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

When referring to the drawing, like reference numbers refer to like elements throughout the various figures that comprise the drawing.

DETAILED DESCRIPTION

Figure 1:
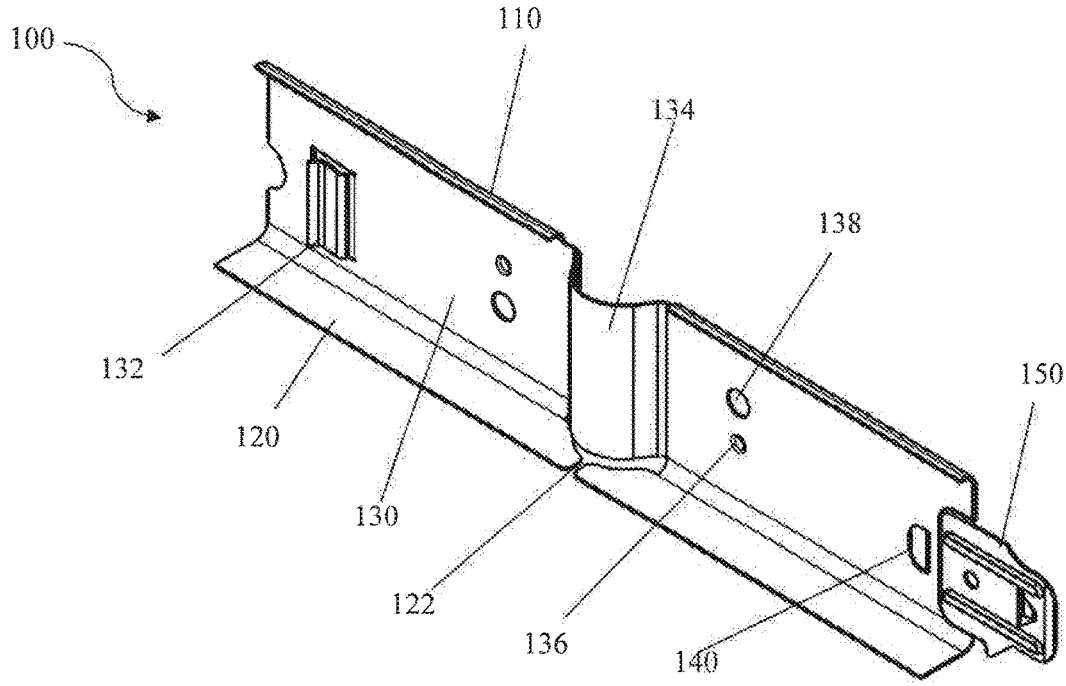
FIG. 1 is a front elevated view of one embodiment of one half of a pass through grid connector.
Figure 2:
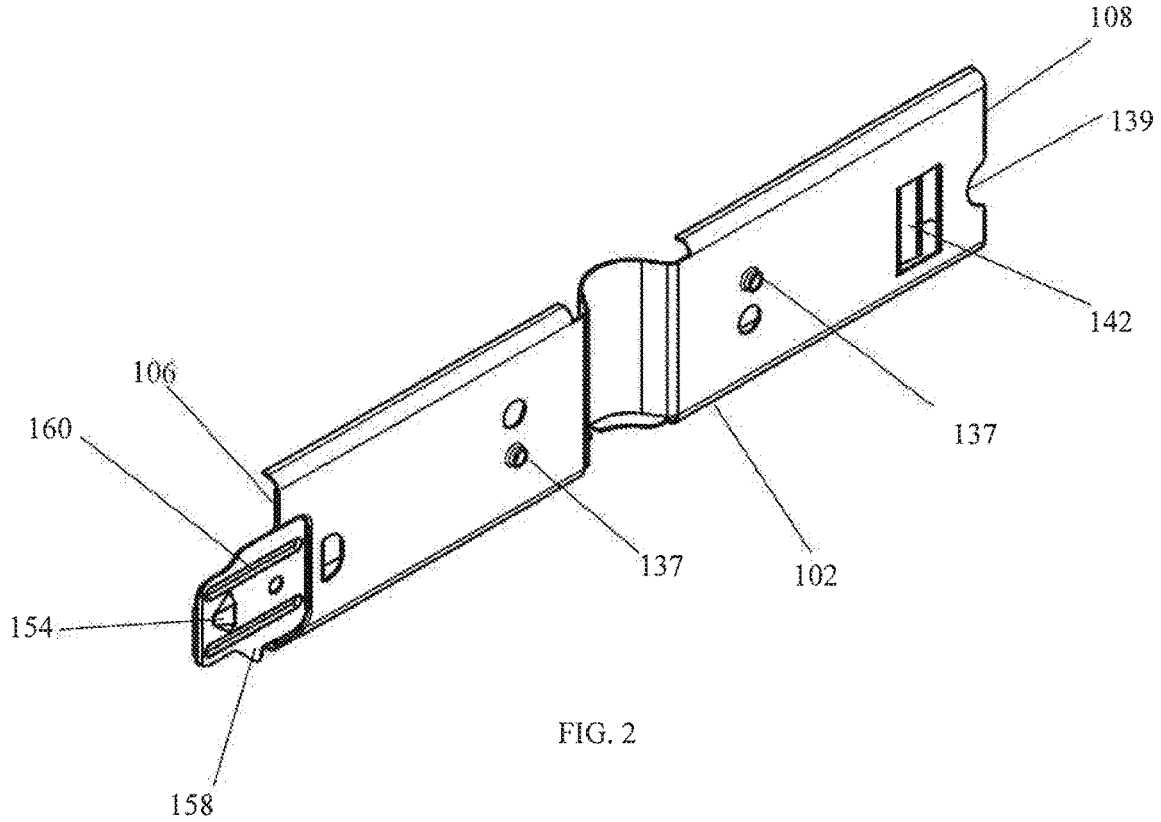
FIG. 2 is a rear elevated view of the one half of a pass through grid connector of FIG. 1.
Figure 3:
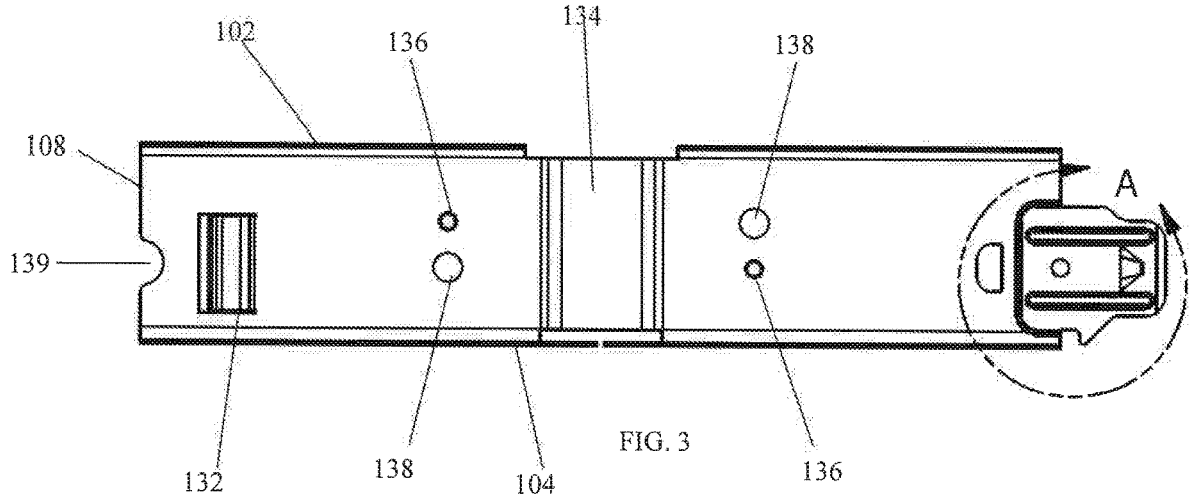
FIG. 3 is a front view of the one half of a pass through grid connector of FIG. 1.
Figure 4:
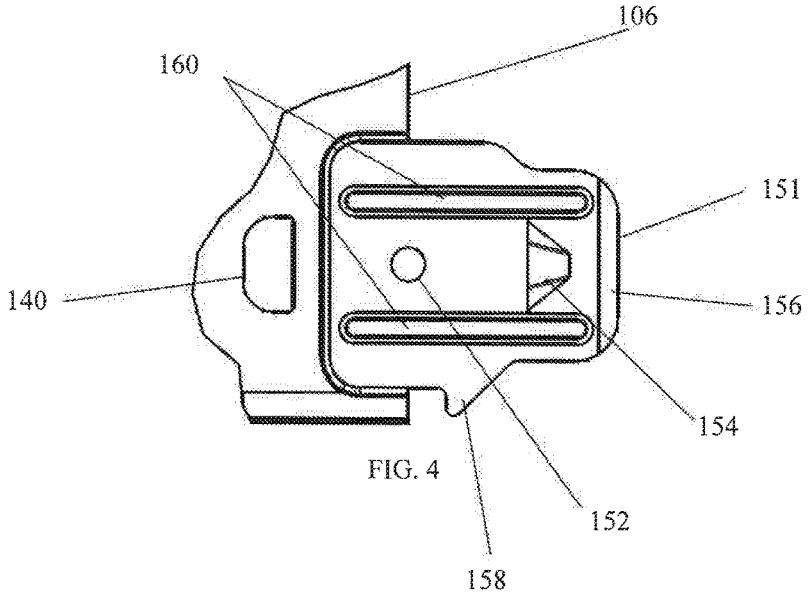
FIG. 4 is a front sectional view of the one half of a pass through grid connector taken on the line A-A of FIG. 3.
Figure 5:
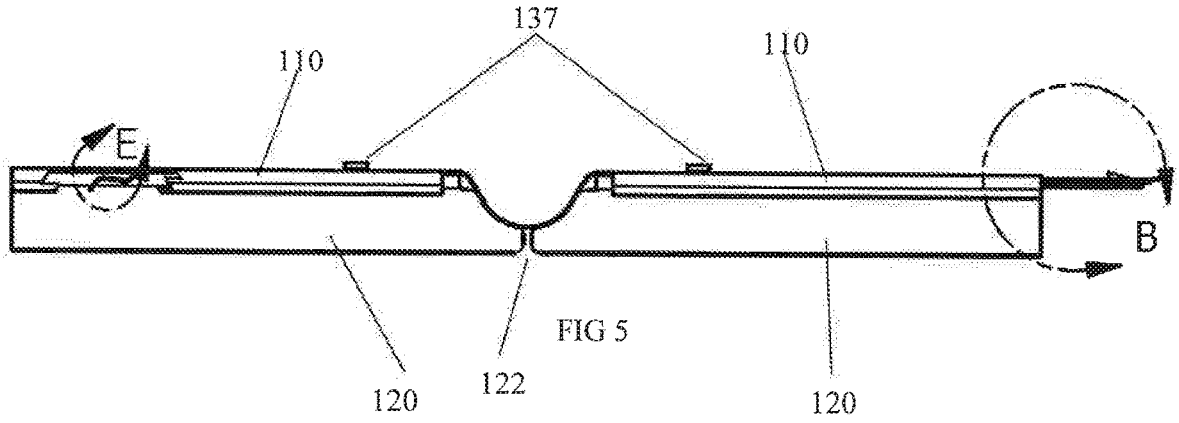
FIG. 5 is a top view of the one half of a pass through grid connector of FIG. 1.
Figure 6:
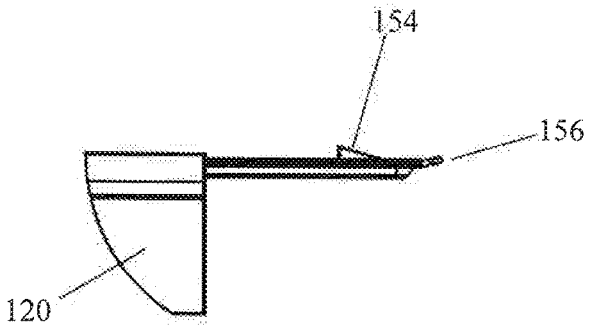
FIG. 6 is a top sectional view of the one half of a pass through grid connector taken on the line B-B of FIG. 5.
Figure 7:
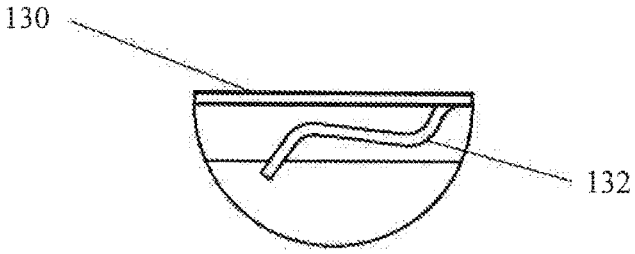
FIG. 7 is a top sectional view of the one half of a pass through grid connector taken on the line E-E of FIG. 5.
Figure 8:
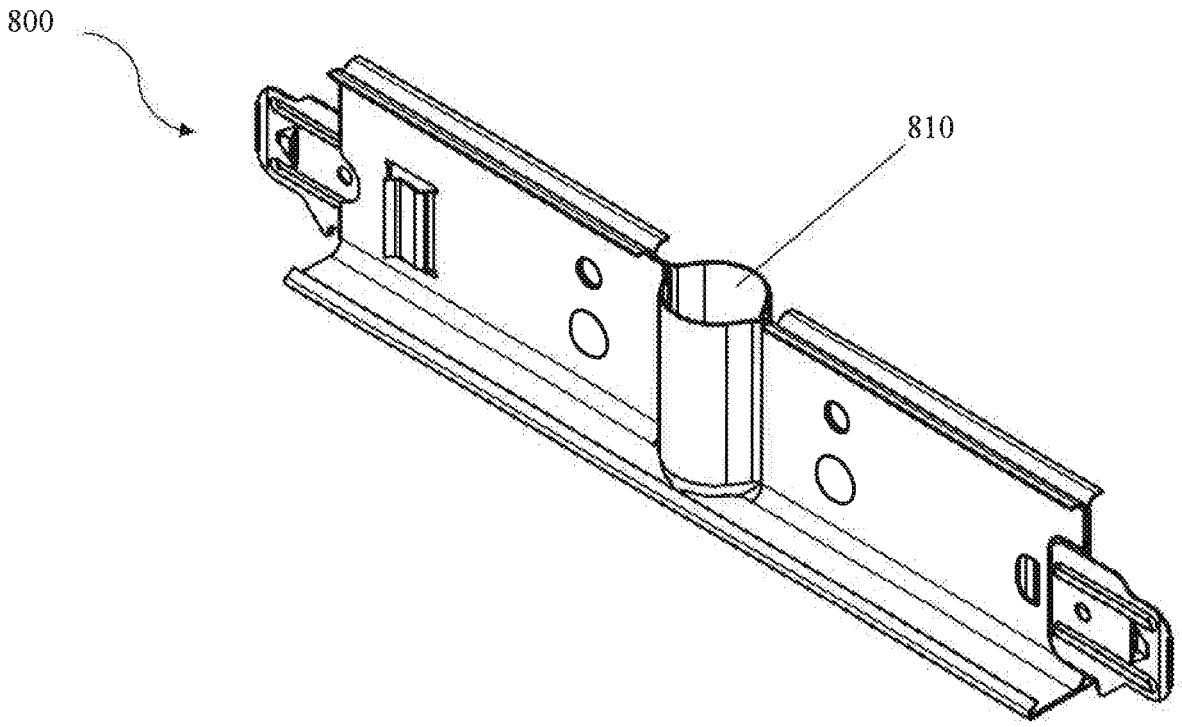
FIG. 8 is a front elevated view of one embodiment of the pass through grid connector clip.

The features and benefits of the disclosure are illustrated and described by reference to exemplary embodiments. The disclosure also includes the drawing. This description of exemplary embodiments is intended to be read in connection with the accompanying drawing, which is to be considered part of the entire written description. Accordingly, the disclosure expressly should not be limited to such exemplary embodiments illustrating some possible non-limiting combination of features that may exist alone or in other combinations of features.

In the description of embodiments, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the figure under discussion. These relative terms are for convenience of description only and do not require that the apparatus be construed or operated in a particular orientation. Terms such as "attached," "affixed," "connected," "coupled," "interconnected," and similar terms refer to a relationship wherein structures are secured or attached to one another either directly or indirectly through intervening structures, as well as both moveable or rigid attachments or relationships, unless expressly described otherwise.

The present pass-thru grid connector 800 for a suspended ceiling in a data center is formed from two identical halves 100 connected back-to-back. In certain embodiments, the halves 100 are connected by a fastener passing through aligned fastener apertures 136 in both halves 100. In other embodiments, the second flange 120 of both halves 100 are joined with a cap 900. In still other embodiments, the halves 100 are connected by a fastener passing through aligned fastener apertures 136 in both halves 100 and a cap 900 joining the second flanges 120 of both halves 100. In other embodiments, the halves 100 are swedged or joined with an adhesive contacting both backs of the halves 100.

Referring to FIG. 1, each half 100 includes a web 130 having a first side 102 and a second side 104 defining a height, along with a third side 106 and a fourth side 108 defining a width. A first flange 110 is connected to the first side 102 and projects substantially perpendicularly out from the web 130. A second flange 120 is connected to the second side 104 and projects substantially perpendicularly out from the web 130 in substantially the same direction as the first flange 110. A clip 150 is further attached to the third side 106.

Web

The web 130 of each half 100 includes a louver element 132 closer to the fourth side 108 than the third side 106. A half-sleeve 134 located between the third side 106 and the louver element 132. The half-sleeve 134 extends from the first side 102 to the second side 104 in a substantially semi-circular shape. The web 130 also includes a first aperture 136 located between the half-sleeve 134 and the third side 106 or the half-sleeve 134 and the louver element 132.

The half-sleeve 134 is adapted to contact a second half-sleeve 134 to form a sleeve 810 in the grid connector clip 800. Neither the half-sleeves 134 nor the sleeves 810 are threaded. In certain embodiments the half-sleeves 134 have a radius of from about 3/16 of an inch (0.4625 cm) to about 5/16 of an inch (0.794 cm). As a result, in such embodiments the sleeve 810 formed from the joining of two half sleeves 134 have a diameter from about 3/8 of an inch (0.925 cm) to about 5/8 an inch (1.588 cm).

Furthermore, in certain embodiments, the half sleeve 134 may be tapered. For example, the half sleeve 134 may commence at a location on the first side 102 that is closer to the fourth side 108 than the location that it terminates on the second side 104. Conversely, the half sleeve 134 may commence at a location on the first side 102 that is closer to the third side 106 than the location that it terminates on the second side 104

The louver element 132 includes a first end connected to the web 130 and an opposite terminal end. The louver element is adapted to engage with a grid clip 820. The louver element 132 may be punched out from the web 130 thereby defining a louver aperture 142. The louver aperture may include an engagement side 144 closest to the fourth side 108 that is also substantially parallel to the fourth side 108. The engagement side 144 may be adapted to engage with a thumbnail 154 of an opposing clip 150 attached to a beam 850. grid In certain embodiments, the louver element 132 is adapted to apply a spring force onto the grid clip 820 in the direction of the web 130 to assist in connecting the grid connector clip 800 to the grid 850. In applying such a spring force, the louver element 132 may initially projects in a direction away from the web 130 and then bends back to project in a direction either parallel to or back towards the web 130.

In other embodiments, the louver element may include a second bend resulting in a terminal end of the louver clip 132 projecting away from the web 130. Such a second bend may assist in guiding a grid clip 820 towards engagement with the louver element 132.

Each half 100 also includes at least one fastener aperture 136, which may also be referred to as a first aperture. The fastener aperture 136 may be defined by a substantially circular protuberance 137 projecting substantially perpendicularly outward from the web 130 in a direction opposite the second flange. The fastener aperture 136 may be located between the half-sleeve 134 and the clip 150 or between the half-sleeve 134 and the fourth side 108.

Each half 100 may also include at least one hanger aperture 138, which may also be referred to as a second aperture. In certain embodiments, the hanger aperture 138 is aligned with the fastener aperture 136 along the height of the web 130. In other embodiments, the hanger aperture 138 is aligned with the fastener aperture 136 along the length of the web 130. In certain embodiments, the hanger aperture is larger than the fastener aperture and adapted to permit the protuberance 137 defining the fastener aperture to pass through.

Each half 100 may also include a connector aperture 140, which may also be referred to as a third aperture. The connector aperture 140 is closer to the clip 150 than the fastener aperture 136.

In certain embodiments, each half 100 may include a notch 139 located on the fourth side 108.

Flanges

Two flanges extend in substantially similar directions out from opposite ends of the web 130. Specifically, the first flange 110 extends out from the first side 102 of the web 130 in the direction of the half-sleeve 134. The second flange 120 extends out from the second side 104 of the web 130 in the direction of the half-sleeve 134.

Neither the first flange 110 or the second flange 120 project out from their respective sides in a continuous manner between the third side 106 and the fourth side 108. In certain embodiments, both flanges includes breaks 122. These breaks 122 occur at the sleeve 134. As a result, neither the first flange 110 or the second flange 120 project out from the sleeve 134. Indeed, the second flange 120 must include a break 122 at the sleeve 134, otherwise the manufacturing process would produce a twisted or torn sleeve 134 or second flange 120.

In certain embodiments, the first flange 110 and the second flange 120 extend in substantially parallel directions and substantially perpendicularly out form the web 130.

In certain embodiments, the second flange 120 is longer than the first flange 110. In other embodiments, the first flange 110 is adapted to engage with bulbs of grid to prevent the grid from rotating.

Clip

The clip 150 includes a terminal end 151 furthest from the third side 106.

In certain embodiments, the clip 150 includes a locking aperture 152. Such a locking aperture 152 may be located closer to the third side 106 than the terminal end 151.

In certain embodiments the clip 150 includes a thumbnail 154 located on the clip 150 and projecting outward from the clip 150 in a direction opposite the second flange 120

In certain embodiments, the clip 150 includes a guide 156 connected to the terminal side 151 of the clip 150 and projecting outward at an angle in a direction away from the second flange 120

In certain embodiments, the clip 150 includes a protuberance 158 projecting outward from the side of the clip 150 closest to the second side 104. The side of the protuberance 158 closest to the third side 106 may be substantially parallel to the third side 106. Such a design is adapted to guide the clip 150 onto grid 850.

In certain embodiments, the clip 150 includes at least one stiffening element 160 projecting outward from the clip in a direction of the second flange. In other embodiments, the clip includes two or more stiffening element 160 aligned along the length of the clip 150 and projecting outward in a substantially parallel direction.

Cap

Figure 9:
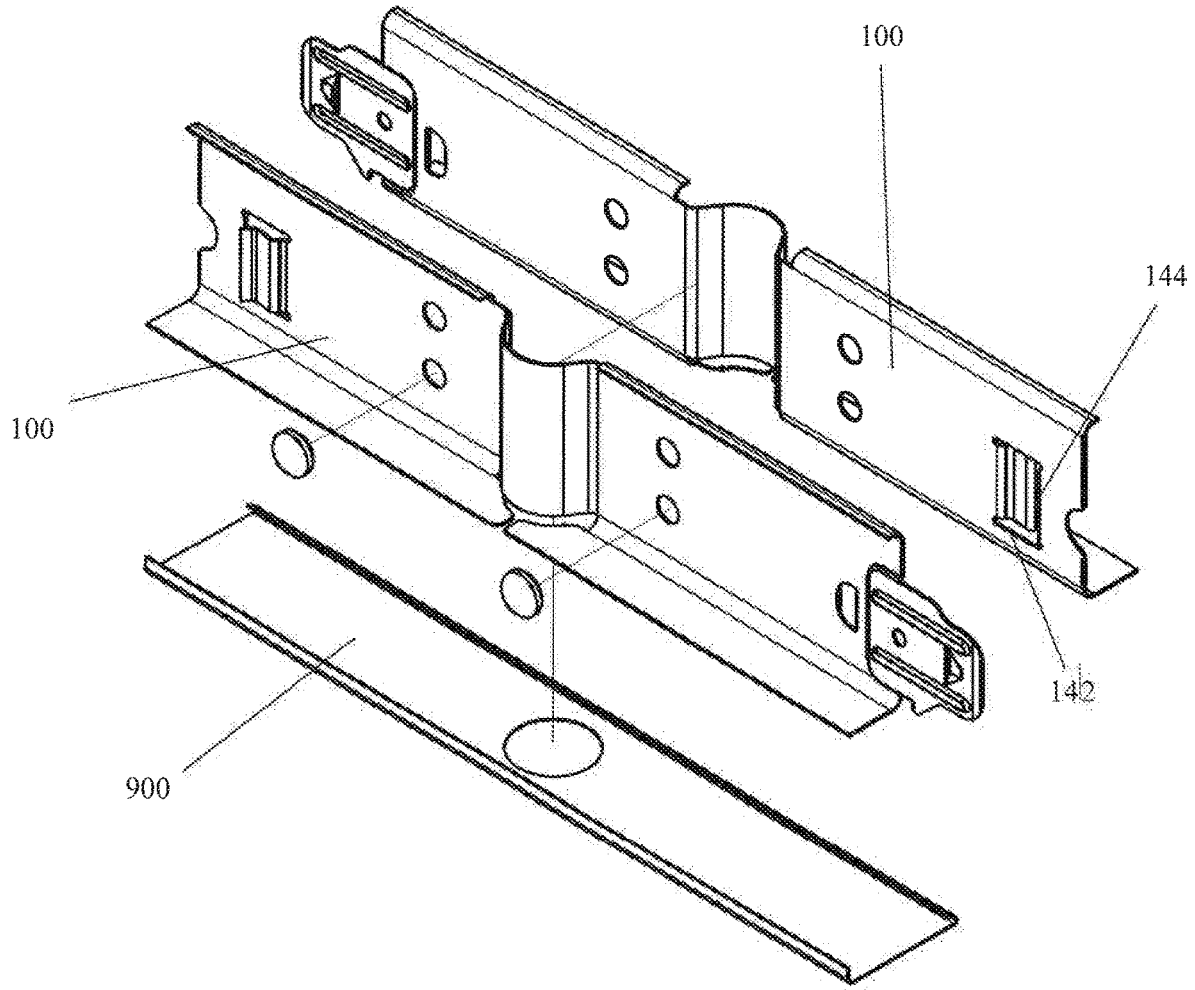
FIG. 9 is an exploded view of the pass through grid connector clip of FIG. 8.
Figure 10:
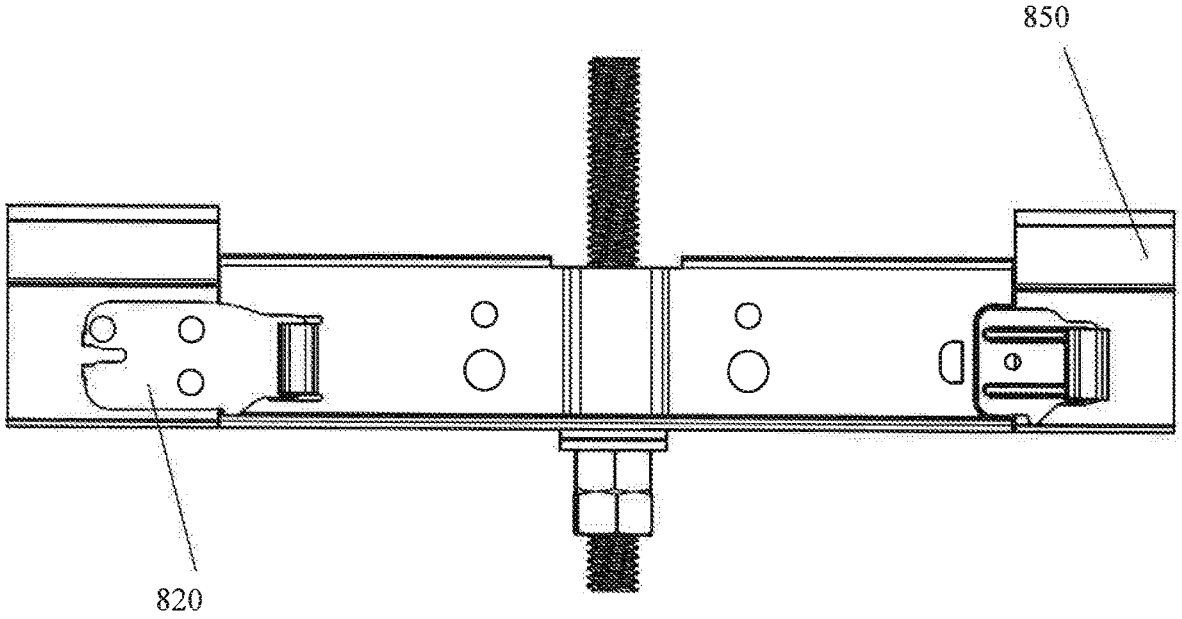
FIG. 10 is a front view of the pass through grid connector clip of FIG. 8 attached to grid beams.

To provide additional structural support, and as illustrated in FIG. 9 a cap 900 may be added to the bottom of halves to join the second flanges 120. The cap includes an aperture substantially centrally located along both the height and width of the cap 900. The cap 900 may be wrapped around to the top of the second flanges 120. Preferably the cap 900 is a separate piece of material. The cap 900 may also be an extension of one or both of the second flanges 120.

Material of Manufacture

It will be understood that the halves 100 and the clip 900 may be constructed out of any bendable material such as metals, polymers, or carbon fiber. Preferably, the halves 100 and the clip 900 are manufactured from metal. More preferably, the halves 100 and the clip 900 are manufactured from rolled steel.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention.

What is claimed is:

1. An identical half of a pass through grid connector for a suspended ceiling, the identical half comprising:

a web having:

a first side and an opposite second side defining a height;

a third side and an opposite fourth side defining a length;

a louver element closer to a fourth side than the third side, the louver element defining a louver aperture having an engagement side substantially perpendicular to the second side;

a half sleeve located between the third side and the fourth side and extending from the first side to the second side in a substantially semi-circular shape for allowing objects to pass through the suspended ceiling;

a fastener aperture located between the half sleeve and the third side or the half sleeve and the fourth side, a clip connected to the third side;

a first flange connected to the first side and projecting outward from the web in the direction of the half sleeve; and a second flange connected to the second side and projecting outward from the web in the direction of the half sleeve.

2. The identical half of claim 1, wherein the clip includes a thumbnail located on the clip and projecting outward from the clip in a direction opposite the first flange.

3. The identical half of claim 1, wherein the fourth side includes a notch.

4. The identical half of claim 1, wherein the web further includes a hanger aperture.

5. The identical half of claim 4, wherein the hanger aperture is aligned with the fastener aperture along the height or length of the web.

6. The identical half of claim 4, wherein a protuberance projecting a distance from the web in a direction substantially opposite the second flange and perpendicular to a plane of the web defines the fastener aperture, 7.

7. The identical half of claim 1, wherein the clip includes a terminal side furthest from the web and a guide connected to the terminal side projecting at an angle in a direction away from the second flange.

8. The identical half of claim 1, wherein the clip includes a protuberance projecting outward in the direction of the second side.

9. The identical half of claim 1, wherein the clip includes at least one stiffening element projecting outward from the clip in a direction of the second flange.

10. A pass through grid connector clip for a suspended ceiling, the grid connector clip comprising:

two identical halves connected back-to-back by a fastener passing through a first aperture of both identical halves or an adhesive contacting the backs of each halve, the identical halves each comprising:

a web having:

a first side and an opposite second side defining a height;

a third side and an opposite fourth side defining a length;

a louver element closer to a fourth side than the third side, the louver element defining a louver aperture having an engagement side substantially perpendicular to the second side;

a half sleeve located between the third side and the fourth side and extending from the first side to the second side in a substantially semi-circular shape;

a fastener aperture located between the half sleeve and the third side or the half sleeve and the fourth side, a clip connected to the third side;

a first flange connected to the first side and projecting outward from the web in the direction of the half sleeve; and a second flange connected to the second side and projecting outward from the web in the direction of the half sleeve wherein the half-sleeves of both identical halves contact each other and form a sleeve for allowing objects to pass through the suspended ceiling.

11. The grid connector clip of claim 10, wherein the clip of each identical half includes a thumbnail located on the clip and projecting outward from the clip in a direction opposite the first flange.

12. The grid connector clip of claim 10, wherein the fourth side of each identical half includes a notch.

13. The grid connector clip of claim 10, wherein the web of each identical half further includes a hanger aperture.

14. The grid connector clip of claim 13, wherein the hanger aperture of each identical half is aligned with the fastener aperture along the height or length of the web.

15. The grid connector clip of claim 13, wherein a protuberance projecting a distance from the web in a direction substantially opposite the second flange and perpendicular to a plane of the web defines the fastener aperture in each identical half.

16. The grid connector clip of claim 10, wherein the clip of each identical half includes a terminal side furthest from the web and a guide connected to the terminal side projecting at an angle in a direction away from the second flange.

17. The grid connector clip of claim 10, wherein the clip of each identical half includes a protuberance projecting outward in the direction of the second side.

18. The grid connector clip of claim 10, wherein the clip of each identical half includes at least one stiffening element projecting outward from the clip in a direction of the second flange.

19. A pass through grid connector clip for a suspended ceiling, the grid connector clip comprising:

two identical halves each comprising:

a web having:

a first side and an opposite second side defining a height;

a third side and an opposite fourth side defining a length;

a louver element closer to a fourth side than the third side, the louver element defining a louver aperture having an engagement side substantially perpendicular to the second side;

a half sleeve located between the third side and the fourth side and extending from the first side to the second side in a substantially semi-circular shape;

a fastener aperture located between the half sleeve and the third side or the half sleeve and the fourth side, a clip connected to the third side;

a first flange connected to the first side and projecting outward from the web in the direction of the half sleeve;

a second flange connected to the second side and projecting outward from the web in the direction of the half sleeve; and a cap joining the second flanges of each of the identical halves together for allowing objects to pass through the suspended ceiling.

20. The grid connector clip of claim 19, further comprising a fastener passing through the fastener apertures of both identical halves.

* * * * *